United States Patent [19]

Pope

[11] Patent Number: 4,655,173

[45] Date of Patent: Apr. 7, 1987

[54] STOCK FOR RESTRAINING AN ANIMAL

[75] Inventor: Charles R. Pope, Conn, Canada

[73] Assignee: Daniel C. Pope, Durham, Canada

[21] Appl. No.: 790,875

[22] Filed: Oct. 24, 1985

[30] Foreign Application Priority Data

Nov. 13, 1984 [CA] Canada ..... 467661

[51] Int. Cl.[4] ..... A61D 3/00

[52] U.S. Cl. ..... 119/103; 119/96

[58] Field of Search ..... 119/103, 98, 99, 100, 119/96

[56] References Cited

U.S. PATENT DOCUMENTS

| | | | |
|---|---|---|---|
| 369,061 | 8/1887 | Kathan | 119/103 |
| 2,631,568 | 3/1953 | Beach | 119/103 |
| 3,389,691 | 6/1968 | Poage | 119/103 |
| 4,214,556 | 7/1980 | Knox et al. | 119/103 |

FOREIGN PATENT DOCUMENTS

| | | | |
|---|---|---|---|
| 122784 | 11/1946 | Australia | 119/103 |

*Primary Examiner*—Gene Mancene
*Assistant Examiner*—David I. Tarnoff
*Attorney, Agent, or Firm*—Daryl W. Schnurr

[57] ABSTRACT

A stock for restraining an animal has a screen with two sides formed into a V-shape. The screen is supported in a frame and there are rods of appropriate thickness and length to extend through openings in the screen on either side of the stock in order to restrain the animal between the rods and the screen. The numerous openings in the screen allow an infinite number of adjustments to be made in the positioning of the rods for animals of different shapes and sizes.

16 Claims, 3 Drawing Figures

STOCK FOR RESTRAINING AN ANIMAL

BACKGROUND OF THE INVENTION

1. Field of the Invention

This invention relates to a stock for restraining an animal, and more particularly, to a stock that can be used to restrain or hold an animal in a fixed position while an operation, vaccination or other purpose is performed.

2. Description of the Prior Art

It is known to have devices for restraining animals, usually pigs, so that operations such as castration can be performed. However, previous devices are not suitable for large animals; they are not readily adjustable for use with animals of various sizes; they do not adequately restrain an animal; they are difficult to use in that it takes a great deal of time and effort to place the animal in the device; they are complex to use; or, they are expensive to manufacture.

It is an object of the present invention to provide a stock for adequately restraining an animal for the purpose of carrying out an operation, vaccination or other purpose, said stock being suitable for restraining animals of various sizes.

SUMMARY OF THE INVENTION

A stock for restraining an animal has a grid having two sides and a V-shaped cross-section with filaments of said grid defining numerous openings therein. There are means to support said grid and rods of appropriate thickness and length to extend through said openings on either side of said grid in order to restrain said animal between said rods and said grid.

Preferably, the means to support said grid is a frame. Still more preferably, said openings are large enough so that part of a skin of the animal being restrained will protrude through some of said openings when said stock is in use.

In a further embodiment, a stock for restraining an animal has two sides, each side formed by a grid. The two sides have a substantially V-shaped configuration, with filaments of each grid defining numerous openings therein. There are means to support the grid and rods of appropriate thickness and length to extend from side to side through both of said grids in order to restrain said animal between said rods and said grids.

DESCRIPTION OF A PREFERRED EMBODIMENT

Figure 1:
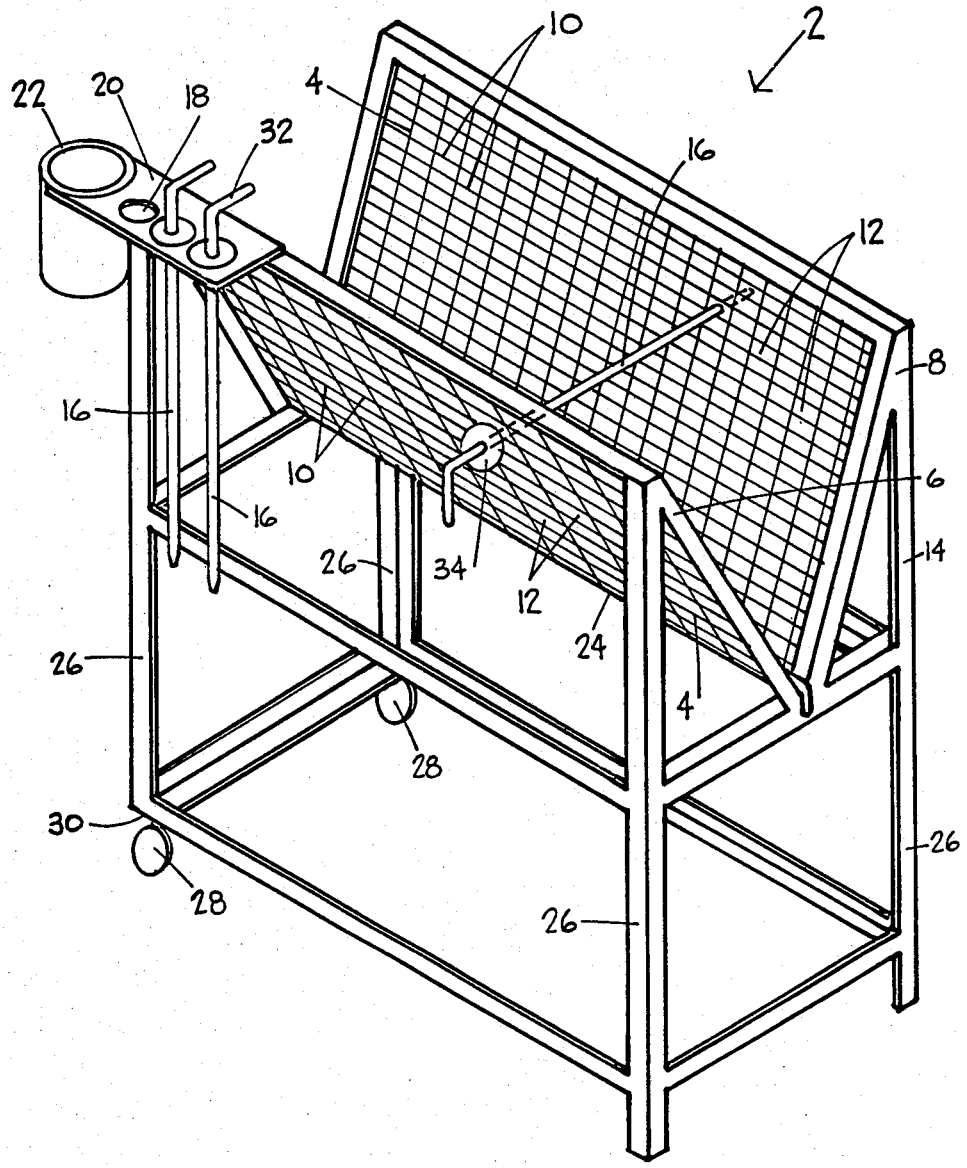
FIG. 1 is a perspective view of a stock having a grid with filaments intersecting each other at right angles.

Referring to the drawings in greater detail, in FIG. 1, a stock 2 for restraining an animal (not shown in FIG. 1) has a grid 4 with two sides 6, 8 in a V-shaped cross-section with filaments 10 of said grid defining numerous openings 12 in said grid 4. A frame 14 provides means to support said grid 4. A rod 16 of appropriate thickness and length extends through an opening 12 on either side 6, 8 of said grid 4. Two additional rods 16 are supported in openings 18 of a storage plate 20. While three rods 16 are shown in FIG. 1 and are usually sufficient to restrain an animal, any reasonable number of rods, whether more or less than three, could be used with the present invention. The number of rods used will depend on the desired degree of restraint and the particular animal being restrained.

Adjacent to the storage plate 20, there is a hollow cylinder 22 that is closed at a lower end thereof and can be used to store disinfectant (not shown) and the like. The frame 14 extends around the periphery of the grid 4 and from end to end along a base of said grid. Legs 26 are a part of said frame 14 with one leg being located at each corner of said stock 2. Two of the legs 26, at one end of the stock 2, have wheels 28 mounted at a base 30 thereof. The wheels assist the mobility of the stock 2 in that it can be readily moved by raising the end without wheels above the supporting surface rather than lifting the entire stock. If desired, wheels could also be located on the remaining two legs. In that case, it would be desirable to have a braking means on said stock so that it will remain in one place during use.

The storage plate 20 provides retainer means for said rods 16 when they are not in use. For ease of handling, each of the rods 16 is bent substantially 90° at one end 32. A disc 34 affixed to each rod 16 near the end 32 so that when the rod is inserted through said grid 4, the disc 34 abuts the grid when the rod has extended an appropriate distance. Also, the disc 34 abuts the opening 18 of the storage plate 20 when the rods are stored.

Figure 2:
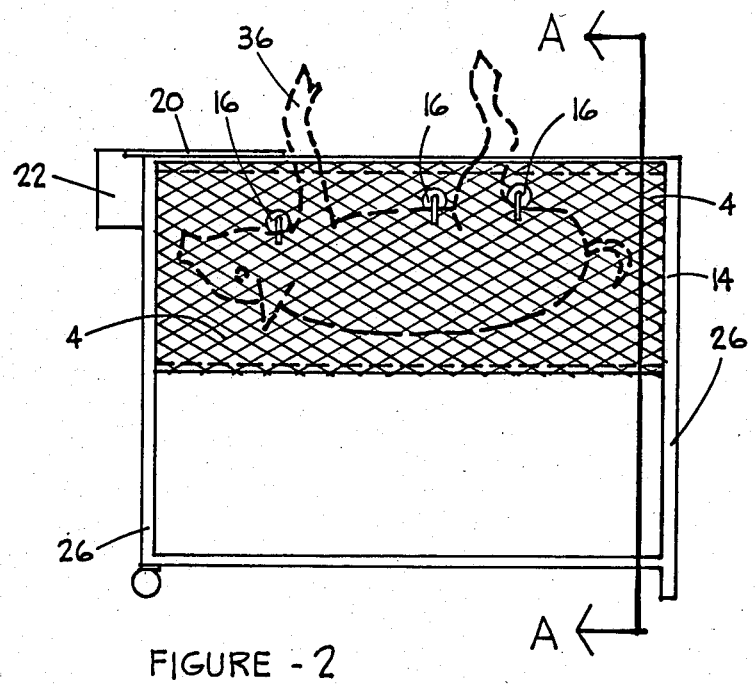
FIG. 2 is a side view of a stock having a grid with filaments intersecting each other diagonally, said stock showing a pig being restrained therein.

The filaments 10 of the grid 4 shown in FIG. 1 intersect each other at right angles. As shown in FIG. 2, the filaments 10 of the grid 4 intersect each other diagonally. Numerous other grids of screens with different configurations could be utilized within the scope of the attached claims. It is important that the openings in the grid or screen are large enough to accommodate a rod of sufficient thickness to adequately restrain the animal. Also, the filaments of the grid or screen within the frame 14 must be sufficiently strong to support the weight of the animal being restrained.

Figure 3:
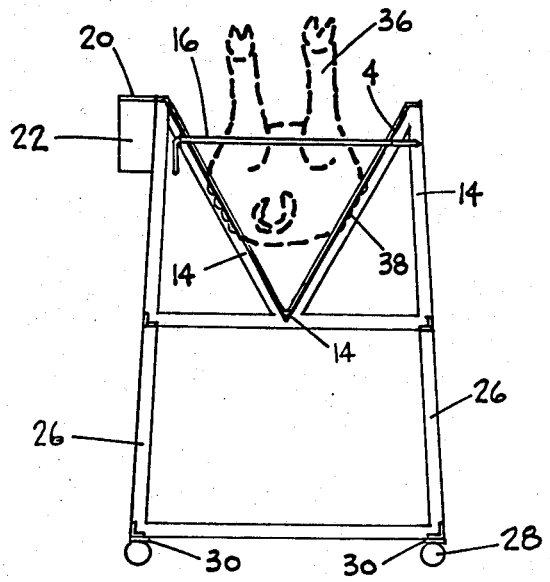
FIG. 3 is a sectional end view of the stock of FIG. 2 along the lines of FIG. A—A of FIG. 2.

In FIGS. 2 and 3, there is shown a stock 2 with rods 16 extending through either side of said grid 4 in order to restrain an animal 36 in an area between said rods 16 and said grid 4. As can best be seen from FIG. 3, a skin 38 of the animal 36 protrudes through some of the openings 12 when said stock is in use. This protrusion assists in restraining the animal on the stand 2.

By using the stock 2, it can be seen that animals of various sizes can be properly and easily restrained as it is a relatively simple matter to place the rods 16 through appropriate openings in the grid. Even if a rod is first placed in the wrong position, it can easily be removed and placed into a proper position. Further, except for placing the rods in different openings, no adjustment is necessary for animals of different sizes. The same procedure is used for all animals regardless of size. The animal is simply placed on its back on the grid and the rods are placed through the grid snugly against the animal to restrain it in position. Also, it is not necessary to adjust the position of the animal lengthwise on the grid. As long as the animal fits properly on the grid, it will be possible to find appropriate openings through which the rods can be inserted to restrain the animal. The rods can be placed in the grid by an operator using one hand and leaving the other hand free to restrain the animal manually until at least one rod has been placed. In most applications, an animal can be restrained in the stock by one operator.

In some uses, it may be desirable to have stocks of various sizes. For example, it may be desirable to have a larger and sturdier stock constructed to restrain full grown pigs and a smaller and lighter stock constructed for smaller pigs. While the large stock can be used to restrain pigs of all sizes, full grown pigs might simply be too large and too heavy for a small stock.

While the stock is designed primarily to restrain a pig during a castration operation, the stock can be used with virtually any animal for any purpose where restraint is desirable.

It will be readily apparent to those skilled in the art to make numerous variations in the stock of the present invention within the scope of the attached claims. For example, it would be a relatively simple matter to design a stock that is collapsible so that it can be stored and transported more easily.

What I claim as my invention is:

1. A stock for restraining an animal comprising a grid having two sides and a V-shaped cross-section with filaments of said grid defining numerous openings therein, means to support said grid, and rods of appropriate thickness and length to extend through said openings on either side of said grid in order to restrain said animal between said rods and said grid.

2. A stock as claimed in claim 1 wherein the means to support said grid is a frame.

3. A stock as claimed in claim 1 wherein said openings are large enough so that part of a skin of the animal being restrained will protrude through some of said openings when said stock is in use.

4. A stock as claimed in claim 2 wherein the frame extends along a periphery of said grid and from end to end along a base of said grid with legs to hold said grid in an upright position on a supporting surface.

5. A stock as claimed in any one of claims 1, 2 or 3 wherein the filaments of said grid intersect other filaments diagonally.

6. A stock as claimed in any one of claims 1, 2 or 3 wherein the filaments of said grid intersect other filaments at right angles.

7. A stock as claimed in any one of claims 1, 2 or 3 wherein there are at least three rods.

8. A stock as claimed in claim 2 wherein the rods are bent substantially 90° at one end.

9. A stock as claimed in claim 8 wherein each rod has a disc affixed to it near said end that is bent so that when said rods are inserted through said grid said discs abut said grid when the rods have extended an appropriate distance.

10. A stock as claimed in claim 4 wherein there are four legs on the stock, one leg at each corner with two of the legs at one end of the stock having wheels mounted at a base thereof.

11. A stock as claimed in claim 9 wherein a hollow cylinder is mounted on the stock, said cylinder being closed at a lower end thereof.

12. A stock as claimed in claim 9 wherein retainer means are mounted on a frame of said stock to hold the rods when they are not in use.

13. A stock for restraining an animal comprising two sides, each side formed by a grid, said two sides having a substantially V-shaped configuration with filaments of each grid defining numerous openings therein, means to support said grid, and rods of appropriate thickness and length to extend from side to side through both of said grids in order to restrain said animal between said rods and said grids.

14. A stock as claimed in claim 13 wherein the means to support said grid is a frame.

15. A stock as claimed in claim 14 wherein said openings are large enough so that part of a skin of the animal being restrained will protrude through some of said openings when said stock is in use.

16. A stock as claimed in any one of claims 13, 14 or 15 wherein there are at least three rods.

* * * * *